United States Patent [19]

Stahlecker

[11] Patent Number: 4,977,738

[45] Date of Patent: Dec. 18, 1990

[54] PROCESS AND A MACHINE ARRANGEMENT FOR SLIVER PROCESSING

[75] Inventor: Fritz Stahlecker, Bad Ueberkingen, Fed. Rep. of Germany

[73] Assignee: Hans Stahlecker, Fed. Rep. of Germany; a part interest

[21] Appl. No.: 308,627

[22] Filed: Feb. 10, 1989

[30] Foreign Application Priority Data

Feb. 19, 1988 [DE] Fed. Rep. of Germany ..... 3805203

[51] Int. Cl.[5] ..... D01H 9/00; D01H 15/00

[52] U.S. Cl. ..... 57/281; 57/90

[58] Field of Search ..... 57/281, 263, 90, 22; 19/159 R, 159 A

[56] References Cited

U.S. PATENT DOCUMENTS

| | | | |
|---|---|---|---|
| 3,246,371 | 4/1966 | Tooka | 19/159 A |
| 3,353,224 | 11/1967 | Gossett et al. | 19/159 A |
| 3,354,513 | 11/1967 | Fornes | 19/159 A |
| 3,884,026 | 5/1975 | Yoshizawa et al. | 57/281 |
| 4,109,357 | 8/1978 | Burow et al. | 19/159 A X |
| 4,642,851 | 2/1987 | Hera | 57/90 X |
| 4,653,263 | 3/1987 | Stahlecker et al. | 57/281 X |
| 4,694,539 | 9/1987 | Langen | 19/159 A |

FOREIGN PATENT DOCUMENTS

| | | | |
|---|---|---|---|
| 0069087 | 1/1983 | European Pat. Off. . | |
| 0220945 | 5/1987 | European Pat. Off. . | |
| 107952 | 8/1974 | Fed. Rep. of Germany . | |
| 2536435 | 2/1977 | Fed. Rep. of Germany . | |
| 2754914 | 6/1979 | Fed. Rep. of Germany . | |
| 3440598 | 5/1986 | Fed. Rep. of Germany . | |
| 3501875 | 7/1986 | Fed. Rep. of Germany . | |
| 213644 | 11/1978 | U.S.S.R. . | |
| 2145122 | 3/1985 | United Kingdom | 19/159 A |

*Primary Examiner*—Joseph J. Hail, III

*Attorney, Agent, or Firm*—Evenson, Wands, Edwards, Lenahan & McKeown

[57] ABSTRACT

In the case of a machine system for the processing of sliver having a first machine, which produces sliver and deposits it in containers, and having a second machine, which processes the sliver from the containers, this second machine being connected with the first machine by a conveying device for the containers, it is provided that automatically operating devices are assigned to the first machine, for the gripping of the end portion of the sliver deposited in each container and for the fixing of this end portion at a specified point of the respective container.

10 Claims, 13 Drawing Sheets

PROCESS AND A MACHINE ARRANGEMENT FOR SLIVER PROCESSING

BACKGROUND AND SUMMARY OF THE INVENTION

The invention relates to a process for processing a sliver which is produced in a first machine and is deposited in containers and which is processed from the containers by a second machine which is connected with the first machine by means of a conveying device for the containers. The invention also relates to a machine arrangement for the processing of the sliver.

It is known (German Patent DD-PS No. 107 952) to feed to a fine-spinning machine, particularly an open-end spinning machine, a sliver in large spinning cans, the contents of which are transferred to small spinning cans by means of a transfer arrangement. The small spinning cans move past the spinning units and past a transfer station in a circulating conveying device and are, as required, applied to the spinning units. In this case, it is known to "solder together", i.e., to connect by rubbing, the end portion of the sliver running out of one of the small spinning cans with the starting portion of the next spinning can.

It is also known (SU-PS 213 644) to introduce a sliver automatically into an aerodynamic open-end spinning machine after an exchange of cans. At the fed cans, a free end portion of the sliver hangs down which is held in a clamped manner at a predetermined point. Before the introduction, the can is aligned with respect to the spinning machine by means of a magnet arranged under the can bottom.

It is also known (German Unexamined Published patent application DE-OS No. 34 40 598) to carry out the exchange of cans by means of a movable cart which is equipped with grippers for the cans. In this construction, the end portion of the sliver is fixed at the can by means of a clamp which is positioned opposite a spinning unit to which the can is applied.

It is also known (German Unexamined Published patent application DE-OS No. 35 01 875, corresponding to U.S. Pat. No. 4,653,263 dated Mar. 31, 1987) to carry out the piecing of a new sliver in the case of an open-end spinning arrangement in such a manner that the yarn count is not changed. Also in this construction, the end portion of the sliver filled into a can is held, in a clamped manner, at the can. This end portion is scanned, after which the can is positioned relative to the spinning unit.

It is also known (German Patent DE-PS No. 25 36 435) to carry out the exchange of cans by means of a movable cart which is equipped with a depositing plate for full cans and a depositing plate for empty cans. The cart has a circulating belt which is equipped with clamps at which the individual end portions of the sliver are held. The mentioned belt brings the clamps with the end portions of the sliver into a specified position in the area of the spinning unit at which the exchange of cans is to be carried out. There, the sliver is taken over by another clamp and is introduced into the spinning unit.

It is also known (European Patent EP-PS No. 69 087) to sense and grip an end portion of a sliver hanging out of a can. For this purpose, sensors are provided which have photoelectric cells, to which clamping jaws are assigned. The cans or the sensors are rotated until the end portion of the sliver is located in the area of the clamping jaws.

It is known (European Patent EP-OS No. 220 945) to search for the end portion of the sliver hanging downward at a can after leaving a first drafting unit in the area of the drafting unit which follows and to grip this end portion of the sliver by means of a gripper. The gripper will then introduce the end portion of the sliver into the second drafting unit.

It is also known (German Unexamined Published patent application DE-OS No. 27 54 914) to provide cans which contain sliver with an electrically or electronically detectable coding, for example, in the form of colored strips which are read by a decoding apparatus of the spinning machine, whereby it is prevented that a wrong sliver is presented at this spinning machine.

An object of the invention is to provide a process of the initially mentioned type by means of which the automatic processing can be carried out more securely.

This object is achieved according to the invention in that, at the first machine, the end portion of the sliver deposited in each container is gripped automatically and is fed to a preset point of the container and is fixed there.

The sliver end portion of the sliver quantity deposited in the container, which represents the starting portion of the sliver in the next machine, is therefore no longer left to itself at any time, so that work can take place with a high degree of security. In contrast, it is provided in all prior art that the sliver either is not brought into a specific position of the sliver container before it reaches the machine processing the sliver further or, at the earliest, during the conveying. This means that, on the one hand, in the case of the processing machine, increased expenditures are required for the searching for the end portion of the sliver, while, on the other hand, there is the danger that, during the transfer to the conveying device and during the conveying, the end portion of the sliver will be lost. During a fully automated operation, such arrangement will as a rule result in considerable difficulties.

In a development of certain preferred embodiments of the invention, a machine arrangement is provided for the processing of sliver, in which automatically operating devices are assigned to the first machine for the gripping of the end portion of the sliver deposited in each container and for the fixing of this end portion at a preset point of the respective container. Also in this development, the end portion of the sliver is taken up immediately and, during the whole time, is held securely until the further processing in the machine which follows.

In a further development of certain preferred embodiments of the invention, devices are provided for separating the end portion of the sliver filled into a container from the sliver running out of the first machine. In an advantageous further development, the devices for the separating are constructed as one or several elements which spread apart the sliver. As a result, the end portion of the sliver is thinned out a little. At the same time, the starting portion, which runs into a can, is also thinned out. When these two parts are connected with one another during an exchange of cans at the machine processing the sliver, for example, by means of rubbing, a connecting point is created which approximately contains a fiber amount which corresponds to the amount of fibers of the other areas of the sliver. As a result, an exchange of cans may take place without stopping the respective spinning unit and without the occurrence of an unacceptable yarn defect.

In a further development of certain preferred embodiments of the invention, it is provided that each container is equipped with devices for holding fast the end portion of the sliver filled into the container. In a further development, it is provided in this case, that the devices for holding fast the end portion of the sliver filled into a container are mounted detachably at the container. As a result, it becomes possible to continue to use the containers used up to now and to retool them with these devices.

According to further developments of certain preferred embodiments of the invention, it is advantageous to assign to the devices for holding fast the end portion of the sliver placed in a container an additional function, so that they have an additional value. In an expedient development, it is provided that the devices for holding fast the end portions of the sliver filled into a container are equipped with an element which is assigned to a positioning device. This may, for example, be a counterpart which matches a gripper of the positioning device.

In another development of certain preferred embodiments of the invention, it is provided that the devices for holding fast the end portion of the sliver deposited in a container are provided with elements which can code information concerning the sliver.

These and other objects, features and advantages of the present invention will become more apparent from the following description when taken in connection with the accompanying drawing which shows, for purposes of illustration only, several embodiments in accordance with the present invention, and wherein:

DETAILED DESCRIPTION OF THE DRAWINGS

Figure 1:
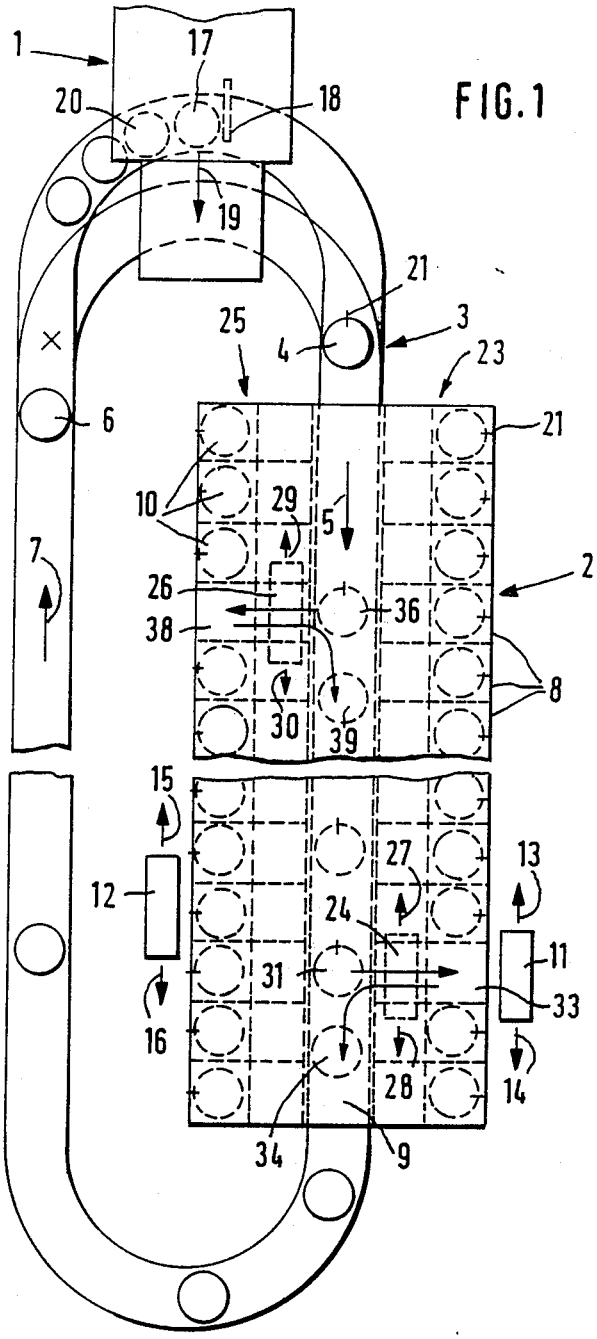
FIG. 1 is schematic plan view of a machine arrangement constructed according to a preferred embodiment of the invention and having a first machine which produces a sliver and deposits it in containers, and having a second machine which further processes the sliver from the containers and which, for example, spins it to a yarn, these two machines being connected with one another by means of a conveying device for the containers.

The machine arrangement shown in FIG. 1 contains a first machine 1, for example, a drafting unit which produces a sliver and deposits it in cans 4. A second machine 2 is connected with machine 1, for example, an open-end spinning machine, which processes the sliver from the cans 4 and spins it to a yarn. Machine 1 and machine 2 are connected with one another by means of a conveying device 3 circulating in the direction of the arrow 7.

The filled containers 4, at which the end portion 21 of the deposited sliver is held at a specified position, move centrally through the machine 2 which is constructed as a two-sided machine. The filled containers 4 are deposited in two rows 23, 25, on each side of the machine, under respective spinning units 8, 10. On the inside, two servicing carts 24, 26 respectively are arranged which can be moved in the direction of the arrows 27, 28 or 29, 30 in longitudinal direction of the machine 2. These servicing carts 24, 26 are used for carrying out the exchange of cans, i.e., to receive the cans of rows 23, 25, which are spun empty, to deposit them on the conveying device 3, to take full cans 4 from this conveying device 3 and to deposit them in rows 23, 25. As shown in FIG. 1, the servicing apparatus 24 has taken out a can 34 at the spinning unit 33, which can 34 was spun empty, and has deposited it on the conveying device 3 on which it moves out of the machine 2 in the direction of the arrow 5. The servicing apparatus 24 will then take over a full spinning can 31 and convey it under the respective spinning unit 33, in which case, the spinning can 31 is positioned such that the end portion of the sliver deposited in it takes on a certain specified position. On the other side of the machine, the servicing apparatus 26 has carried out a corresponding process; i.e., it has taken out a can 39, which was spun empty, at the spinning unit 38 and transferred it to the conveying device 3. It must now still bring the full can 36 into row 25 under spinning unit 38.

The applying of the sliver to the corresponding spinning units 33, 38 will then take place bY means of additional servicing apparatuses 11, 12 which correspondingly patrol along the spinning units 8, 10 of the two sides of the machine in the direction of the arrows 13, 14 or 15, 16. The servicing carts 24, 26 may be designed corresponding to the construction of DE-OS 34 40 598, and the servicing carts 11, 12 may be designed according to the construction of U.S. Pat. No. 4,653,263.

The empty containers 6, via a shunt, arrive in a waiting line in front of the machine 1, in which the containers 17, 20 are located. Container 17, which is aligned by means of a positioning device 18, is just being filled, whereas container 20 stands ready as the next can. At the shunt, the full containers 4, which have not yet been needed in machine 1, are separated from the empty containers 6, in which case the full containers 4 move directly to machine 2 while by-passing machine 1. As soon as container 17 is filled, it is placed on the conveying device 3 in the direction of the arrow 19. In the case of this transfer, as will be explained later, the end of the end portion 21 deposited in the container 4 will be fixed in an exactly specified position.

Figure 2:
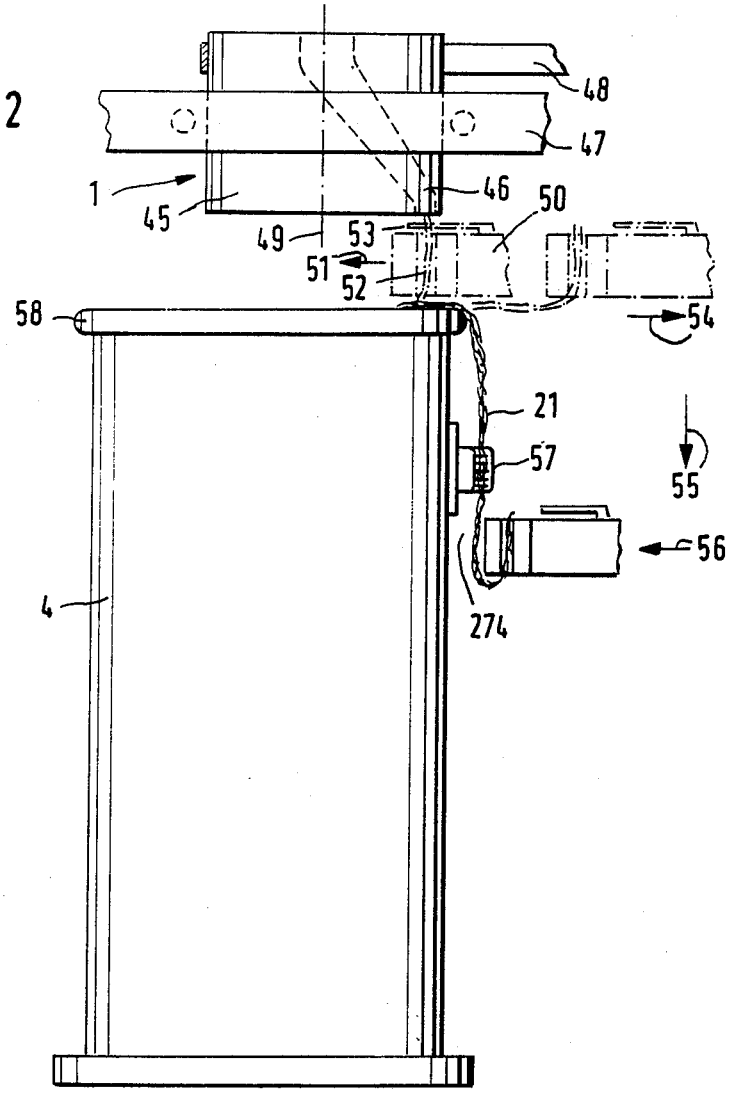
FIGS. 2 to 6 are schematic views of devices for gripping the end portion of the sliver and for fixing it at a preset point of the respective filled-off container constructed according to respective preferred embodiments of the invention.

FIG. 2 is only a very schematic view of an embodiment for devices by means of which the end portion of the sliver, during an exchange of cans, can be gripped at the machine producing a sliver and can be fixed precisely at the can 4. Of the machine 1 producing the sliver, such as a drafting unit, only one rotary plate 45 is shown which is disposed in a holding device 47 and, by means of a belt 48, is driven to perform a rotation. The rotary plate 45 rotates around its vertical axis 49, a sliver 52 moving out of it from a mouth of a fiber duct 46 arranged eccentrically with respect to the axis of rotation 49. It is assumed that the sliver container has been moved out from under the rotary plate 45, while the rotary plate 45 continues to run and continues to furnish sliver 52. This sliver 52 is gripped by a gripping arm 50 which can be advanced in the direction of the arrow 51 and is cut off closely below the rotary plate 45 by means of a cutting device 53. The gripping arm 50, together with the sliver 52 held by it, will then move back in the direction of the arrow 54 and then toward the can 4 and vertically downward on it in the direction of the arrow 55. Then the gripper 50 is also applied radially to the can 4, in the direction of the arrow 56, until the end portion 21 of the sliver arrives in the area of a holding device 57 fastened at the exterior wall of the can, in which the end portion 21 of the sliver 52 is fixed.

In the embodiment according to FIG. 2, a type of needle board is provided as the holding device 57 over which the end portion 51 of the sliver is fitted. As shown in FIG. 2, the holding device 57 projects relatively far out in radial direction, i.e., as far as over the bead 58 of the can 4. As a result, below the holding device 57, a clearance 274 is created into which first gripper 50 can be moved, while also later, another gripper can be easily applied to this clearance 274, this gripper being used for taking the end portion 21 of the sliver off again. After the end portion 21 of the sliver deposited in the can 4 is transferred into the holding device 57, the gripper opens up and moves back into its starting position.

While the can 4 is located under the rotary plate 45, it stands on a can plate, which is not shown and is driven to perform rotations, this can plate rotating around an axis which is slightly eccentric with respect to the axis 49 of the rotary plate 45. When the can 4 is moved out, attention must be paid to the fact that the receiving device 57 is in the position in which it can be reached by the gripper 50; i.e., the can 4 must be positioned with respect to the gripper arm 50.

Figure 3:
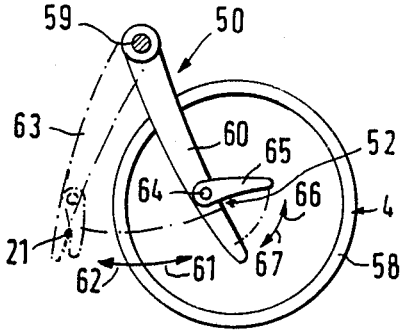
Figure 4:
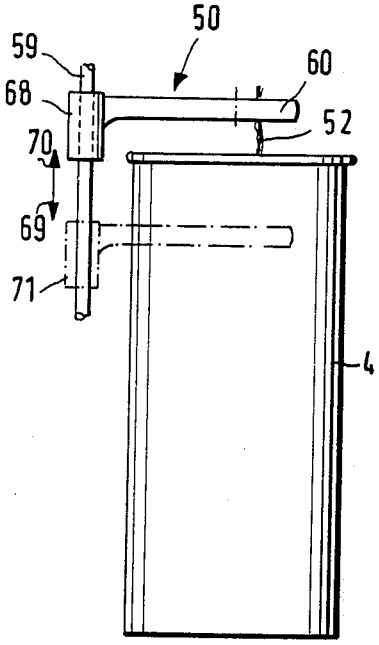

In FIGS. 3 and 4 another embodiment of a gripper 50 is shown. The gripper 50 contains a gripper arm 60 which can be swivelled around a shaft 59 which is parallel with respect to the axis of the can 4 and which, by means of a guide 68, can be moved in vertical direction on the shaft 59 in the direction of the arrows 69, 70. At the end of the gripper arm 60, a gripping finger 65 is located which forms tongs together with the end of the gripper arm 60. This gripping finger 65 can be swivelled in the direction of the arrows 66, 67 around a shaft 64 which is in parallel to the shaft 59. The gripper arm 60, with opened tongs, swivels in the direction of the arrow 61 into the area of the sliver 52 coming from the rotary plate or the like. Subsequently, the gripping finger 65 is swivelled in the direction of the arrow 67, so that the sliver 52 is clamped. Then the arm 60 swivels back in the direction of the arrow 62 into position 63 next to the spinning can 4. As a rule, no additional cutting device for the sliver 52 is required. In most cases, the relative movement between the gripper arm 60 and the rotarY plate is sufficient in order to cut the sliver 52 so that a sliver end portion 21 is obtained which is held in position 63 of the gripper arm 60 next to the can 4. In position 63, the gripper arm 60 is then moved downward (direction of arrow 69) into position 71. In this position 71, it swivels toward the circumference of the can 4 in the direction of the arrow 61 and, in the process, transfers the end portion 21 of the sliver deposited in the can 4 to a holding element which is not shown. Then the gripping finger 65 is opened, and the gripper arm 60 is moved back.

Figure 5:
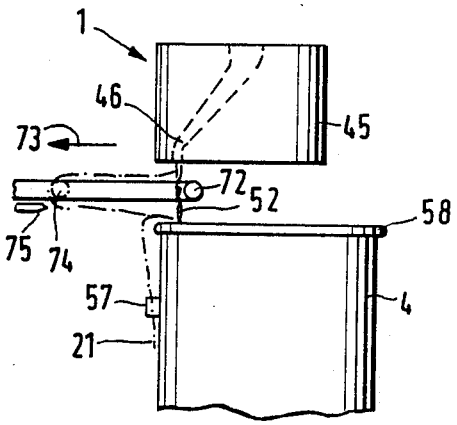

In the embodiment according to FIG. 5, it is assumed that the rotary plate 45 of the machine 1 and the can plate, which is not shown and on which the spinning can 4 is arranged, come to rest in a preset position. The sliver 52, by means of a gripping hook 72, is then pulled out under the rotary plate 45 in the direction of the arrow 73 to position 74 and is cut by a cutting device 75. The cut end 21 of the sliver deposited in the can 4 will then fall downward over the edge 58 and is caught by a holding device 57.

Figure 6:
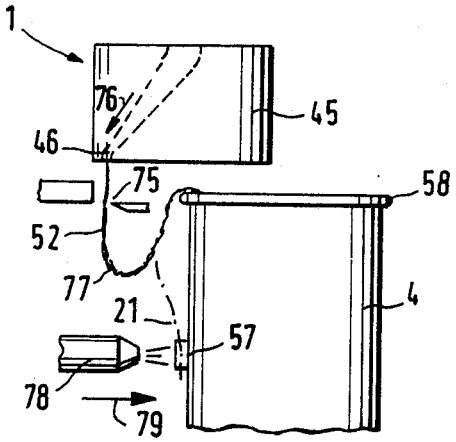

In the embodiment according to FIG. 6, the can 4 is already moved out under the rotary plate 45. In this case, the can 4 is held in a position in which the holding device 57 takes up a defined position with respect to the circumference of the can 4. The rotary plate 45 is stopped, but continues to furnish the sliver 52. This sliver 52, which hangs over the edge 58 of the can 4 in a loop 77, is then cut by a cutting device 75 so that it falls downward. In this area, a blowing nozzle 78 is applied to it in the direction of the arrow 79 which blows the end portion 21 into the holding device 57 and therefore secures it.

Figure 7:
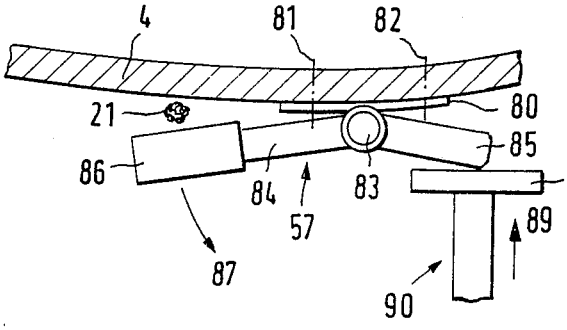
FIGS. 7 to 10 are schematic views of devices for the clamping-fast of the end portion of the filled-in sliver and devices for opening these devices constructed according to respective preferred embodiments of the invention.

In FIG. 7, a section is shown of a can 4 having a holding device 57 constructed as a clamping holder. The holding device 57 has a bearing 80 which is fastened on the outside at the wall of the can 4 by means of two rivets or screws 81, 82. A two-armed lever 84, 85 can be swivelled around a swivel shaft 83, the thickened end 86 of this lever 84, 85 serving as a clamp for the end portion 21 of a sliver 52 which is deposited in the can 4 and hangs down over the edge 58 of the can. The double-armed lever 84, 85 is loaded by a spring, which is not shown, in clamping direction, i.e., against the direction of the arrow 87. For the opening of the holding device 57, an actuating element 90 is applied to the free arm 85 in the direction of the arrow 89, this actuating element 90, by means of a plate 88, placing itself against the arm 85 and, as a result, swivelling the double-armed lever 84, 85 in the direction of the arrow 87 for the release of the end portion 21. An actuating element 90 must be present at least in the area of the machine 1, by means of which the holding device 57 constructed as a clamp is opened for the introduction of the end portion 21. In the area of the spinning machine, in which then the taking-over of the end portion 21 takes place, under certain circumstances, a gripper may be sufficient which grips the end portion 21 of the sliver between the edge 58 of the can 4 and the clamping holding device 57 and simply withdraws it. If this point of application takes place at a distance which is larger than the staple length of the sliver 52, the sliver 52, shortly before the area of its clamped held end portion 21, is pulled apart and separated in a simple manner. However, it is also contemplated to provide an actuating element 90 in the area of the device which carries out the piecing of the end portion 21 of the sliver as the new starting portion of the sliver 52 to be introduced.

Figure 8:
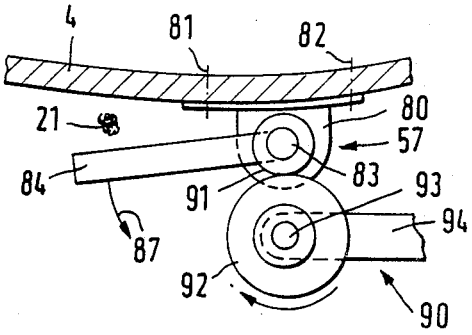

The embodiment according to FIG. 8 corresponds largely to the embodiment according to FIG. 7. Instead of a double-armed lever, however, only one lever arm 84 is provided which is loaded by means of a spring into the clamping position and which can be swivelled around the shaft 83. The arm 84 is non-rotatably connected with a wheel 91 to which a driving wheel 92 of an actuating element 90 can be applied which is driven around a shaft 93 of a holding device 94. Therefore, it is also contemplated to swivel the arm 84. The take-along wheel 91 and the driving wheel 92 may be constructed as frictional wheels or as toothed wheels.

Figure 9:
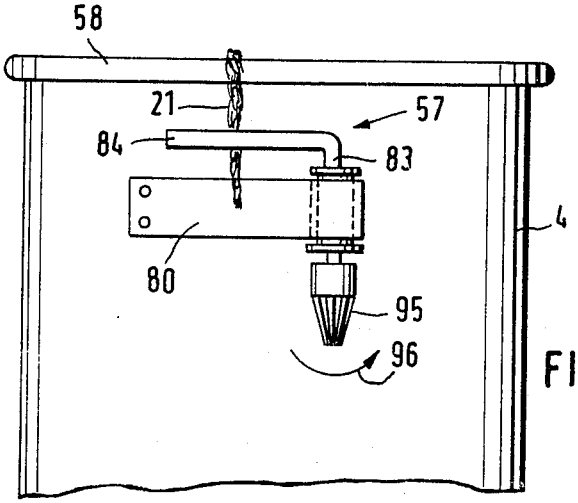

FIG. 9 is a lateral view of an embodiment which corresponds largely to the embodiment according to FIG. 8. In this embodiment, the take-along wheel is constructed as a conical wheel 95 which is non-rotatably connected with the shaft 83 of the arm 84, which is non-rotatably fastened on the shaft 83. A mating wheel of an actuating device, which is not shown and which has a corresponding conical recess, can be fitted onto this conical wheel 95, so that the arm 84 can be turned above it.

Figure 10:
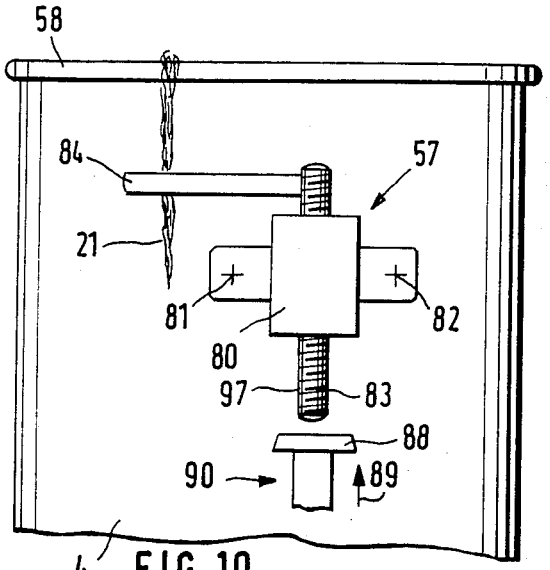

In FIG. 10, another embodiment is shown which is constructed similarly to FIGS. 8 and 9. The arm 84 of this holding device 57 is fixedly connected with a threaded spindle 83 which has a thread 97 having a very steep pitch. The bearing 80 is constructed as a corresponding internal thread. By means of the axial shifting of the threaded spindle 83, the arm 84 is therefore turned. This axial shifting takes place in one direction, i.e., in the clamping direction, by means of a spring, which is not shown or, if necessary, by means of the dead weight. The opening takes place by means of an actuating element 90 which, by means of a thrust piece 88, can be applied to the spindle 83 in its axial direction in the direction of the arrow 89.

Figure 11:
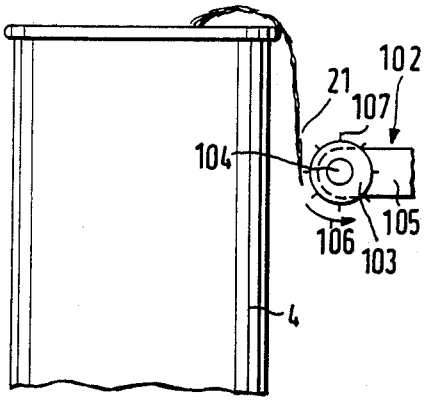
FIG. 11 is a schematic view of a device for the thinning-out of the end portion of a sliver hanging over an edge of a can constructed according to a preferred embodiment of the invention.

FIG. 11 shows a can 4, the end portion 21 of a sliver deposited in the can 4 hanging down over the edge 58 of this can 4. The end portion 21, in a manner not shown in detail, may be fixed in a preset position. A combing wheel 103 is applied to the end portion 21, this combing wheel 103 being arranged on an arm 105 and is rotatable around a shaft 104 and is equipped with a mounting 107. The combing wheel 103 is driven in the direction of the arrow 106, i.e., with a moving direction toward the free end of the end portion 21. The combing-out device shown in FIG. 11 may be a component of the elements which fasten the sliver directly following the first machine 1 of a machine system, or of the elements which later carry out the exchange of cans of the second machine 2.

Figure 12:
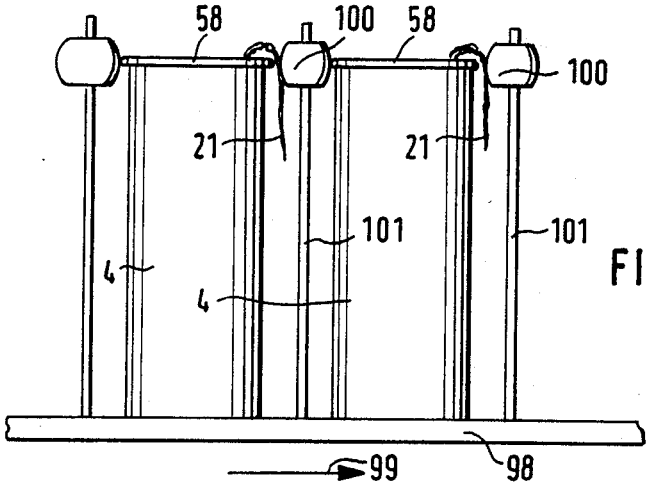
FIG. 12 is a schematic view showing devices of a conveying device for securing the end portion of the sliver at a certain position during the conveying constructed according to preferred embodiments of the invention.

In the embodiment according to FIG. 12, it is provided that the end portion 21 of the sliver deposited in a can 4 is hung down only loosely over the edge 58 of the can 4, but from a defined position. As the conveying device, an individual cart, a conveyor belt, a hang holder or the like, is provided to which the cans 4 are transferred. This conveying device 98, which moves in the direction of the arrow 99, is equipped with buffer-type clamping elements 100, which are arranged on rods 101 and which, in the area of the edges 58, clamp the end portion 21 of the slivers against them. These clamping elements 100, which consist of a rubber-elastic material, will then hold the sliver in the desired position during the transport. In the case of this embodiment, it is assumed that, during the exchange of cans at the first machine 1 as well as at the second machine 2, the danger is considerably reduced that the end portion 21 of the sliver is lost.

In a large spinning mill, the conveying of the sliver containers 4 may be designed to be such that first all sliver containers 4 arrive at a collecting point, specifically in direct proximity of a group of spinning machines 2. The sliver containers 4 are then conveyed from this collecting point to those spinning units 8, 10 which give a signal that a sliver container 4 is running out or will run out shortly. A central control point follows the consumption of sliver at the machines 2, recognizes the data of all sliver containers 4 and, based on these data, organizes the exchange of the sliver containers 4. It is of interest here with respect to economics that the waiting time of a full sliver container 4, before it reaches a spinning unit 8, 10, is as short as possible. Today, a "buffer" of full spinning containers 4 still exists in the spinning mills. This is necessary because it is not possible without automation to organize production in an ideal manner. This means that presently too much money is tied up in the spinning mill which is represented by a large stock of sliver. A spontaneous change-over to another fiber material is also made difficult, because first the existing supply of sliver of the in-process stock should be used up. This is one of the important arguments for an automatic exchange of sliver containers 4. Financially, the saved manipulations alone are not of extreme importance. It should be taken into account, however, that often such manipulations are carried out with a delay, which is expensive. In the case of a computer-controlled sliver container exchange, there are no delays.

Each machine 2 processing sliver, for example, each rotor spinning machine, has as many drafting units 1 as it required. It is naturally expedient for the drafting units to be located in direct proximity of the spinning machines 2. However, this type of an assignment is not always as important as in the known combination of ring spinning machines and spooling frames.

In the case of spinning machines 2, it must be assumed that, while the sliver count remains the same, differently fine yarns are spun. When a transition is made to finer yarn counts, the sliver requirement is reduced correspondingly which means that the drafting units 1 assigned to the spinning machines 2 would no longer be used to full capacity. It may therefore prove to be preferable to assign to a group of spinning machines 2 a certain number of drafting units 1, in which case, controlled by a computer, the production of these spinning units 1 will be distributed optimally to the spinning machines 2.

For the spinner, it is of primary importance that the full sliver containers 4 do not wait too long before they are presented to a spinning machine 2. All fiber material, which is located in the spinning mill as a permanent condition, requires the payment of interest. A large stock of full sliver containers 4 also has a negative effect on the flexibility during the exchange of batches. There is always the fear that sliver containers 4 will be left over when, for example, a change is made to other fiber material or to a slightly different cotton. Also, in the case of such a large stock of full sliver containers 4, production defects have a much more drastic effect than when there is direct consumption. When it is found at one spinning machine 2 that the sliver quality is unsatisfactory, and that a correction must therefore be made at the drafting unit 1, such a correction is too late for the already filled sliver containers 4. The more filled sliver containers 4 are in circulation, the more extensive the damage will be.

Figure 13:
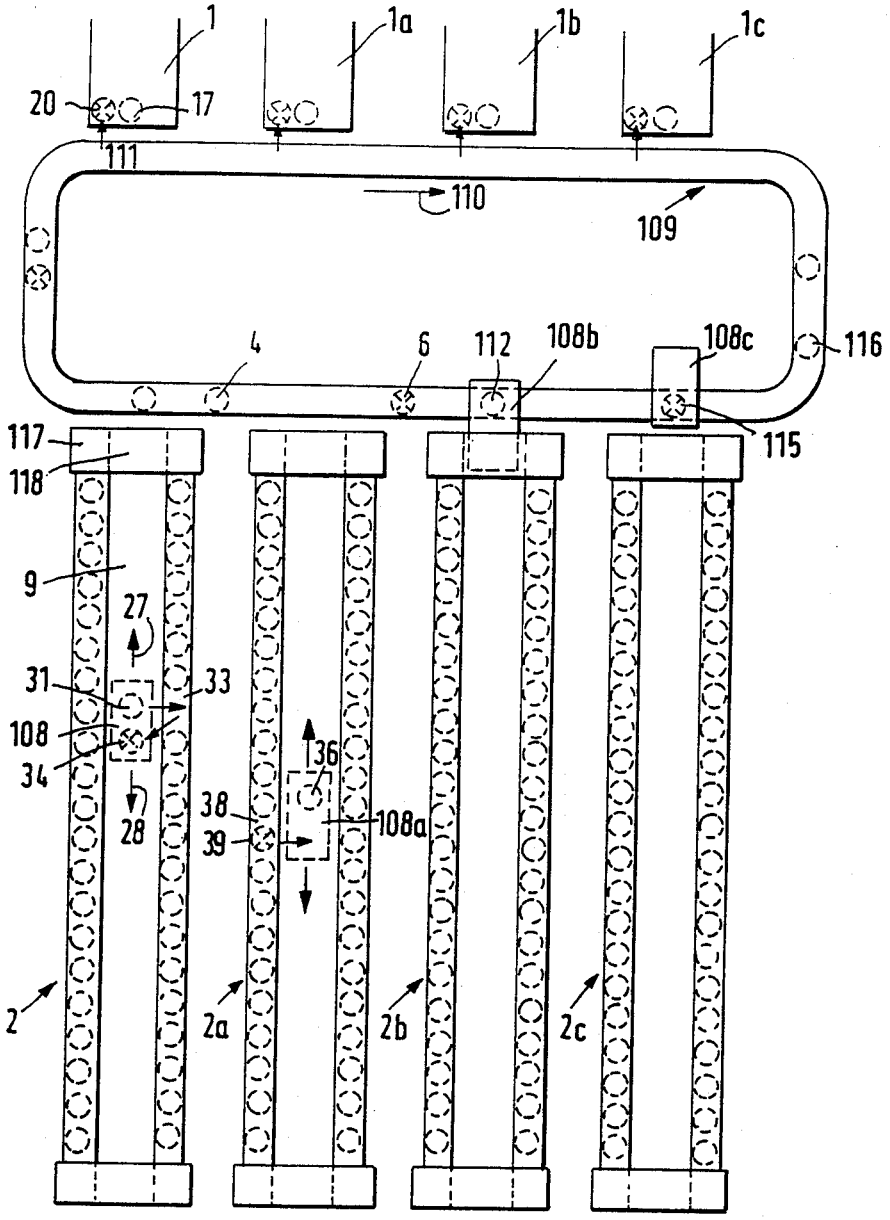
FIG. 13 is a schematic plan view of a machine arrangement constructed according to a preferred embodiment of the invention having several machines producing sliver and depositing it in cans, and several machines processing the sliver from the cans, these machines being connected with one another by means of a joint conveying device.

FIG. 13 shows a machine system, in which four sliver-producing machines 1, 1*a*, 1*b*, 1*c* are connected with four sliver-processing machines 2, 2*a*, 2*b*, 2*c* by means of a conveying device 109. In this case, it is not necessary that the same yarn count is spun on all sliver processing machines 2, 2*a*, 2*b*, 2*c*, as long as the same sliver material is spun. It must then only be taken care that at those machines, at which a coarser count is spun, the sliver containers 4 must be exchanged more frequently.

For the purpose of an explanation, the empty sliver containers 6 are marked with an x. In the embodiment according to FIG. 13, the conveying device 109, which circulates in the direction of the arrow 110, is constructed as a storage device. The empty sliver containers 6 are returned to the machines 1, 1*a*, 1*b*, 1*c* which are provided with their own waiting lines for empty sliver containers 6, of which one is shown with the reference number 20. The sliver-processing machines 2 each contain a servicing cart 108, which can be moved back and forth in the direction of the arrows 27, 28 in longitudinal direction of the machines 2 and which exchanges empty sliver containers 6 for full sliver containers 4 and takes them over from the conveying device and transfers them. The servicing cart 108 has taken out an empty sliver container 34 at the spinning unit 33 of spinning machine 2 and is just in the process of applying a full sliver container 31 to this spinning unit 33.

The servicing cart 108*a* is just taking over an empty sliver container 39 from spinning unit 38 to which subsequently a full sliver container 36 must be applied. The servicing cart 108*b* of the spinning machine 2*b* is just taking over a full sliver container 112 from the conveying device 109, while the servicing cart 108*c* of the spinning machine 2*c* is just transferring an empty sliver container 115 to the conveying device 109. It must then wait until the next full sliver container 116 has arrived in its range so that it can be taken over.

In the following embodiments, holding devices 57 are shown and explained which are all mounted at a container 4 in which a sliver is deposited.

Figure 14:
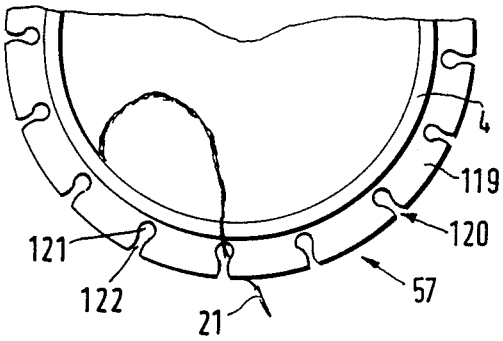
FIGS. 14 to 46 are schematic views of respective embodiments constructed according to the invention of devices for fixing the end portion of the sliver filled into a can at a container, particularly at a can.

In the embodiment according to FIG. 14, the sliver container 4 is equipped with a ring 119, particularly a plastic ring, which has a plurality of keyhole-type recesses 120 having a narrowed inlet 122 and an expanded guide opening 121. Instead of a complete ring 119, a more or less long ring section may also be used. The end portion 21 of the sliver deposited in the container 4 is pulled into the recess 120. At the time of the restarting, a search for the end portion 21 of the sliver must then take place. If an optical sensor is provided, it is expedient to provide the container 4 with a banderole in the area of the ring 119, from which the fiber material of the sliver differs very clearly.

Figure 15:
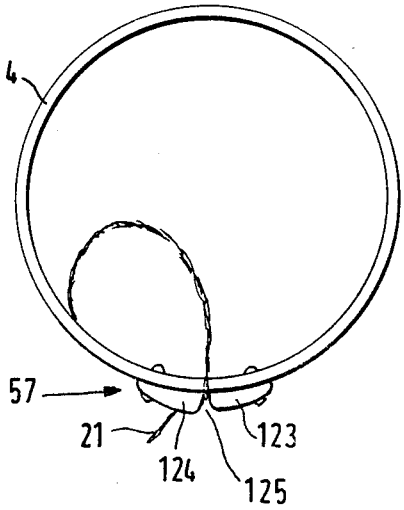

In the embodiment according to FIG. 15, two plastic blocks 123, 124 are mounted at the exterior side of the container 4, these plastic blocks 123, 124 forming a receiving slot 125 between one another for the end portion 21 of the sliver deposited in the can 4. The plastic blocks 123, 124 are slightly rounded in their outer contour. The plastic blocks 123, 124 of the holding device 57 may be fastened directly at the container 4 by means of screws or rivets or they may be mounted on a band-shaped holder.

Figure 16:
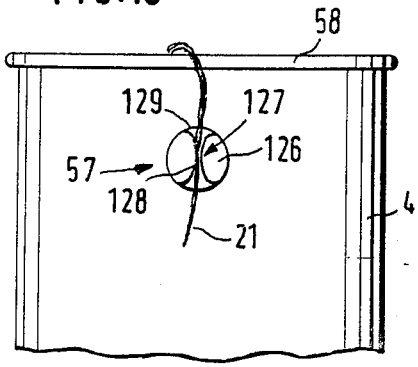

In the embodiment according to FIG. 16, a plastic body 126 is mounted at a distance below the edge 58 of the can 4, this plastic body 126 being provided with a groove 127 which has a narrowing 128 and two expansions 129. The end portion 21 of the sliver is held in the groove 127 of this holding device 57 in a slightly clamping manner.

Figure 17:
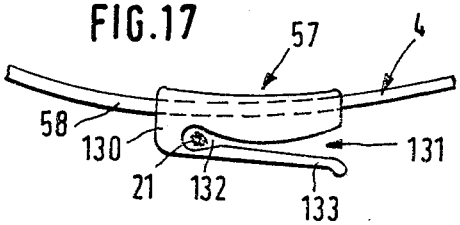

In the embodiment according to FIG. 17, a holder 130 is hung in or clipped in from above on the edge 58 of a container 4. The holder 130 is constructed as a clamp having a clamp leg 133 which extends approximately in circumferential direction. This clamp leg 133, together with the holder 130, forms a narrowing threading slot 131 which, at its end, expands again to an approximately round area 132 in which the end portion 21 of the sliver is finally held.

Figure 18:
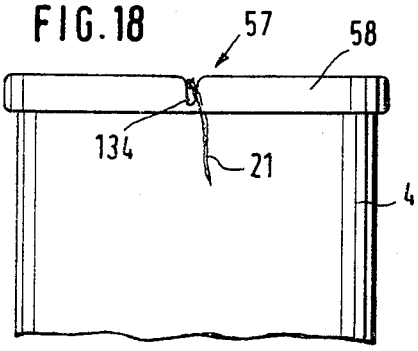

In the embodiment according to FIG. 18, the sliver container 4 is provided in the area of its edge 58 with one or several radially directed, slot-type recesses 134, which are used as holding devices 57 for the end portion 21 of the sliver. This actually very simple solution is, however, only suitable if the sliver, during further processing, is withdrawn from the can 4 in clearly upward direction and must not run over the profiled edge 58.

Figure 19:
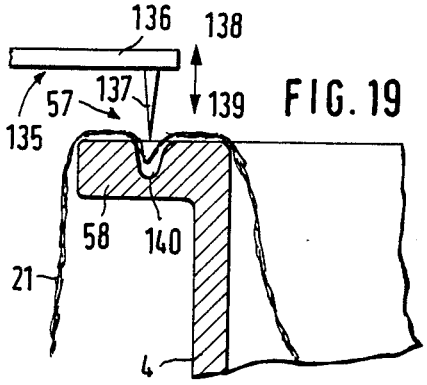

In the embodiment according to FIG. 19, the edge 58 of the can 4 is provided with a groove 140 which extends over only a part of the circumference or over the whole circumference. The end portion 21 of the sliver, which is placed over the edge 58 is locked in this groove 140 by means of an inserting device 135. The inserting device 135 has an arm 136 with a needle-shaped pressure element 137 which can be moved into and out of the groove 140 in the direction of the double arrow 138, 139. Embodiments are also contemplated wherein, instead of one needle-shaped pressure element 137, several are provided.

Figure 20:
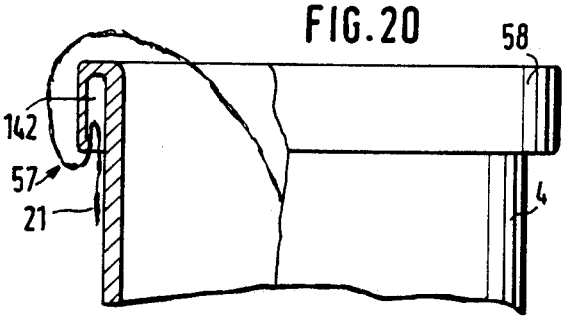

The embodiment according to FIG. 20, in principle, corresponds to the embodiment according to FIG. 19. In this embodiment, the underside of the edge 58 of the can 4 is provided with a groove 142, into which the end portion 21 of the sliver is pressed and fixed in the manner of a loop.

Figure 21:
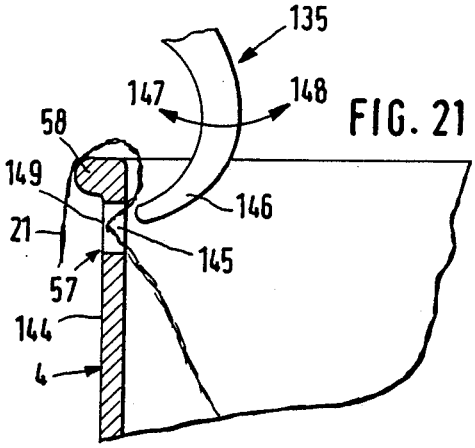

In the embodiment according to FIG. 21, the wall 144 of a sliver container 4 is provided with a window 145 at a distance below the edge 58, which window may have a rectangular cross section or a keyhole shape. In this embodiment, the end portion 21 of the sliver is pressed into the window 145 in the shape of a loop 149 by means of a swivelling inserting device 135. The inserting device 135 has a finger 146 which can be swivelled in the direction of the arrows 147, 148. It would also be possible to pull the end portion 21 of the sliver completely through the window 145 and to fix it in this manner. However, in this case, the later handling would be slightly more cumbersome.

Figure 22:
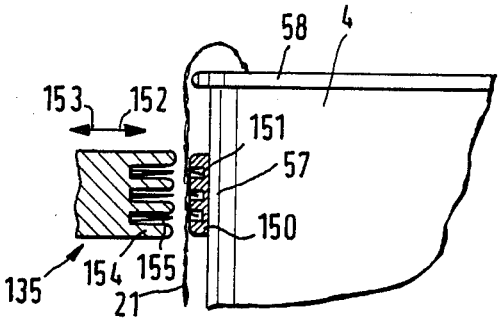

In the embodiment according to FIG. 22, the sliver container 4 is equipped on its exterior side with an orifice plate 150 which has three or four holes 151 of a diameter of approximately 5 mm. The end portion 21 of the sliver, by means of an actuating device 135, which can be moved in the direction of the arrows 152, 153, is pressed into the holes 151. This actuating device contains a block 154, out of which needles 155 move. By means of the block 154, the sliver end portion 21 is first clamped above and below the orifice plate 150, while then the needles 155 press the sliver into the holes 151. Then the needles withdraw, while the block 154 still holds the sliver.

Figure 23:
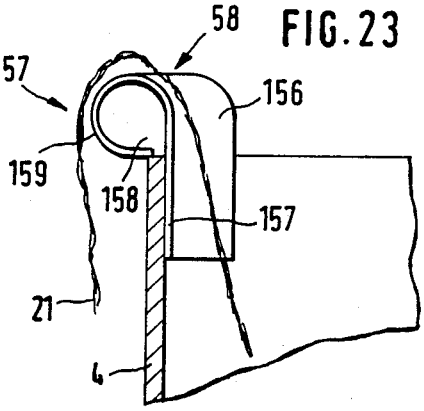

In the embodiment according to FIG. 23, a holder 156 serves as the holding device 57 for the end portion 21 of the sliver deposited in a container 4, this holder 156 being fastened at the edge 58. This holder 156 has a tab-type area 157 which rests on the interior against the can wall and changes over into an approximately cylindrical enlargement 158. The enlargement 158 is provided in its outer area with a friction surface 159 or a roughening or structuring. This friction covering 159 ends below the vertex.

As a development of the embodiment according to FIG. 23, it is provided that the holder 156 or the edge enlargement of a can directly is provided with a friction agent or adhesive. As a further development, it may be provided that these adhesives, in the form of a spray, are not applied until immediately before the end portion 21 of the sliver is secured, for example, by the devices which grip the end portion 21 of the sliver and deposit it at the defined position at the edge of the can. Naturally, this type of an adhesive spray may also be applied at a distance under the can. This applying of the holding device 57 by the devices for the gripping and fixing of the end portion 21 of the sliver has the advantage that, for this purpose, the can 4 itself may take up any arbitrary position and does not have to be positioned with respect to its circumferential direction. This naturally also applies to cases in which the devices for the gripping and fixing mount clamping holders or the like at the edge of the can or at the can.

Figure 24:
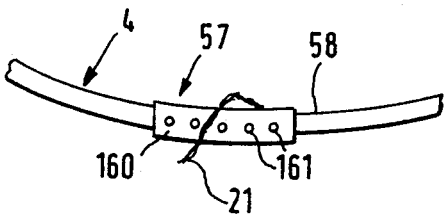

In the embodiment according to FIG. 24, a component 160 serves as the holding device 57 which is fitted onto the edge 58 of the can and is equipped with one or several needle rows 161, into which the end portion 21 of the sliver deposited in the can 4 is hung.

Figure 25:
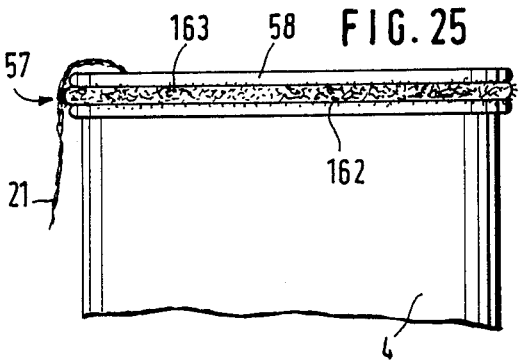
Figure 28:
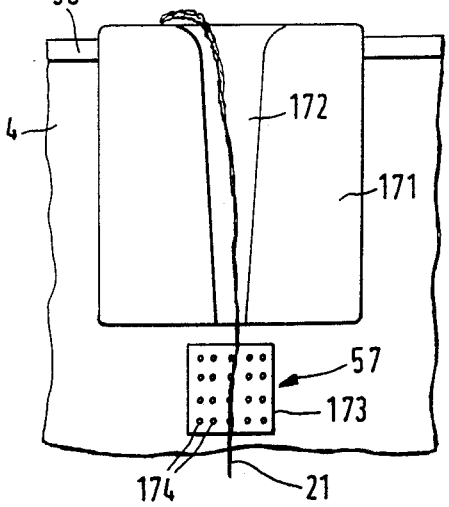

In the embodiment according to FIG. 25, a strip 163 is used as the holding device 57 which is placed in a groove 162 of the edge 58 of a can 4, this strip 163 being a velcro-type strip or a plush-type cord or the like, from which spike-type elements project which exercise a certain adhesive effect on the end portion 21 of the sliver. Holding devices 57 of this type must be cleaned from time to time because fibers of the end portion 21 of the sliver adhere to them. This may take place, for example, by means of the piecing carriage of the spinning arrangement or by a separate cleaning station.

Figure 26:
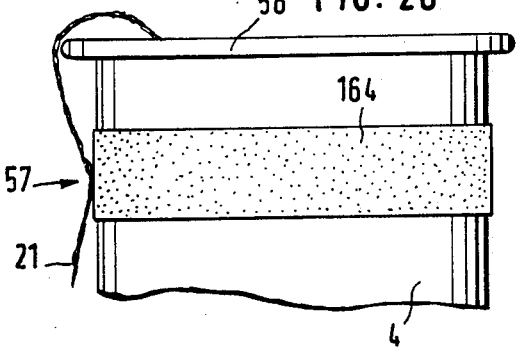

In the embodiment according to FIG. 26, a strip-type covering 164 is used as the holding device 57 which may consist of the same material as the holding device of the embodiment according to FIG. 25. As shown in FIG. 26, the covering 164 is arranged at a distance under the edge 58 of the can 4. The edge 58 projects over the circumference of the can 4 relatively far, so that the sliver can be guided in a loop shape and can be gripped relatively easily by a gripping element.

Figure 27:
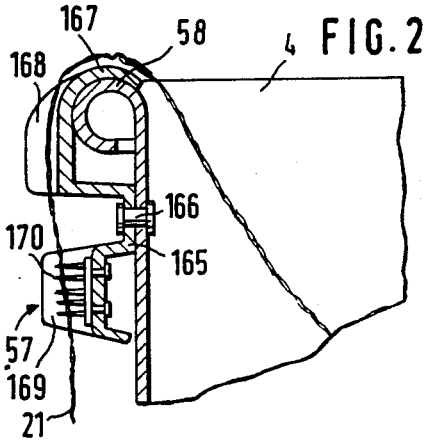

In the embodiment according to FIG. 27, the holding device 57 is a component 165 which is fastened on the outside of the wall of the can 4 by means of a rivet 166, this component 165, by means of a nose 167, reaching around the edge 58. This nose 167 is followed by a guide groove 168 which laterally guides the end portion 21 of the sliver.

Behind a space, the guide groove 168 is continued by a guide groove 169, on the bottom of which a needle bar 170 is arranged. In this embodiment, the end portion 21 of the sliver can be held at a relatively large radial distance from the can wall so that it can be easily reached by a gripping element.

In the embodiment according to 28, a guide element 171 is hung over the can edge 58, this guide element 171 having the shape of a plate which is provided on the outside with a guide groove 172 which narrows in downward direction. Under this guide groove 172, a plate 173 is located as the holding device 57, this plate 173 being provided with needles 174 into which the end portion 21 of the sliver is moved.

Figure 29:
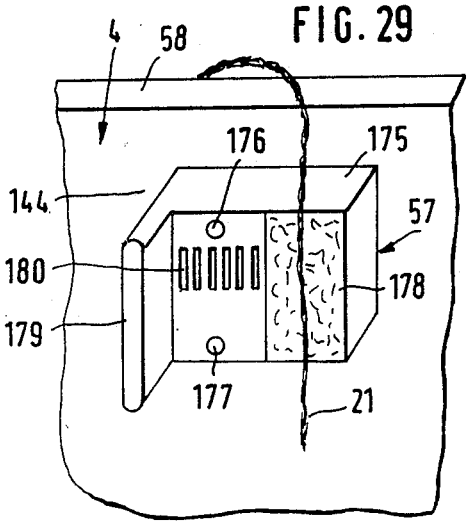

In the embodiment according to FIG. 29, the holding device 57, in the form of a basic body 175, is mounted at a distance under the edge 58 of the can 4 at its outer wall. The basic body 175 is fastened by means of rivets 176, 177 or by means of screws or the like. It has an adhesive covering 178, at which the end portion 21 of the sliver is held. As the adhesive covering, needles or a clamp or the like may also be provided. The basic body is also provided with a projection 179 projecting in the shape of a strip which is used for the application of a positioning tool or the like or as a stop during the positioning. The positioning tool or the positioning device is a component of the devices for gripping and fixing the end portion 21 of the sliver and/or of the piecing carriage or of the servicing cart transferring the cans 4 into the spinning position.

The basic body 175 is also provided with a surface to which markings 180 are applied which contain information on the contents of the container 4. This marking 180 may be printed on by means of a stamp or may be applied electronically or photographically.

Figure 30:
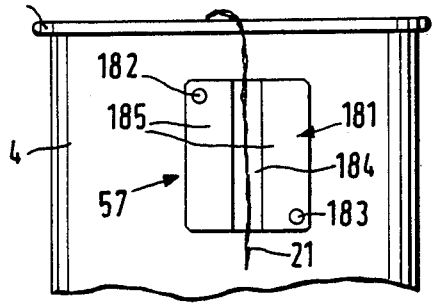

In the embodiment according to FIG. 30, at a distance below the edge 58 of the can 4, a plate 181 is mounted as the holding device 57 by means of rivets 182, 183 or screws or the like. The plate 181 may also be glued on. The plate 181 has a vertically aligned groove 184 which is delimited by lateral elevations 185. The bottom of the groove 184 is provided with a material to which the end portion 21 of the sliver deposited in the can 4 adheres. The bottom of the groove 184 is provided, for example, with an electrostatically chargeable material which is charged electrostatically in such a manner that the sliver adheres to it. In a further development, it is provided that the groove bottom is equipped with a permanent magnet. Before the fixing, the end portion 21 will then be provided with a magnetically attractable material, such as iron dust. This iron dust, which may be applied in liquid form or in the form of a solution, adheres to the end portion 21 of the sliver and causes it to be held in the groove 184. The electrostatic charging or the providing of the sliver end portion 21 with a magnetically attractable material expediently takes place by the devices which are provided for the gripping of the sliver end portion and the fixing of the sliver end portion.

Figure 31:
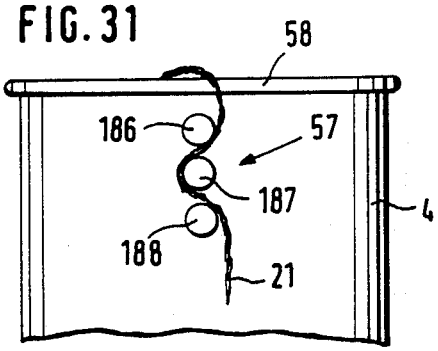

In the embodiment according to FIG. 31, several buttons 186, 187, 188 are provided as holding devices 57 on the outside of a can 4 below the edge 58; in this embodiment, there are three buttons. The starting portion 21 of the sliver is inserted between these buttons 186, 187, 188, so that it is secured by means of the friction. It is sufficient when these buttons 186, 187, 188 project from the wall of the can 4 with an approximate length of 1 cm.

Figure 32:
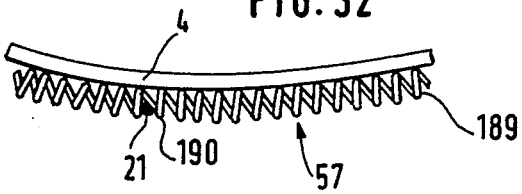

In the embodiment according to FIG. 32, a coil spring 189 is used as the holding device 57 which, on the outside, is placed around the outer wall of the can 4. The coil spring 189 is layered with plastic. The end portion 21 of the sliver deposited in the can 4, by means of the devices for the gripping and fixing, is placed between two spring windings 190 of the coil spring 189, and is held there in a slightly clamping manner, if the windings of the coil spring have a distance which is smaller than the diameter of the sliver in the unloaded state. As a development of the shown embodiment, it is contemplated to mount only a short piece of a coil spring 189 at a defined position at the exterior wall of the can 4. The coil spring 189 may be arranged in this case directly below the edge of the can 4 or at a distance below the edge of the can 4. As a further development of the shown embodiment, a lamella strip is provided instead of a coil spring 189, the individual lamellae of this lamella strip being easy to open so that the end portion 21 can be easily inserted between the lamellae.

Figure 33:
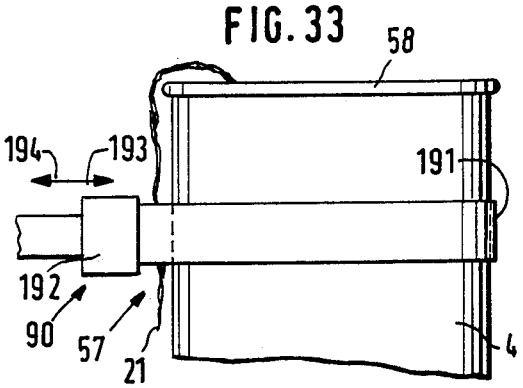

In the embodiment according to FIG. 33, a ring 191 consisting of a band-shaped rubber-elastic material which, at a distance from the edge 58 of the can 4, is placed around this can 4, is used as the holding device 57. The ring 191, by means of an actuating device 90, which can be moved in the direction of the arrows 193, 194, is slightly pulled off so that the end portion 21 of the sliver can be inserted between the can wall and the ring 191. Subsequently, the ring 191 is released again so that the end portion 21 is secured. The pulling-off of the ring 191 may take place, for example, by means of a suction head 192 of the actuating device 90. However, it is also contemplated to fasten a gripping tab at the ring 191 which may be gripped and taken along by gripping tongs of the actuating device 90.

Figure 34:
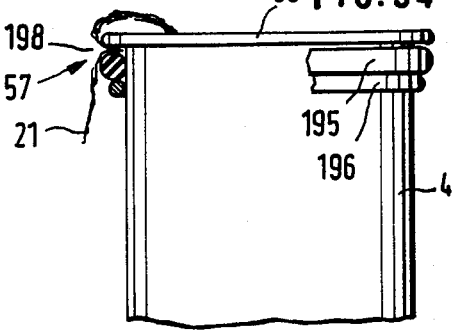

In the embodiment according to FIG. 34, a rubber-elastic ring 195 is used as the holding device 57, which braces a loop 198 of the end portion 21 of the sliver from below against the underside of the edge 58. The ring 195 is placed in a groove which is formed bY the edge 58 and a ring 196, such as a plastic ring, which is mounted fixedly under it. It is easily possible to press the rubber-elastic ring 195 downward at one point so that the underside of the edge 58 of the can 4 is exposed. After the ring 195 is released, it returns to its starting position so that it then clamps in the loop 198 of the end portion 21 of the sliver, if this end portion was previously placed in this position by the devices for the gripping and fixing.

Figure 35:
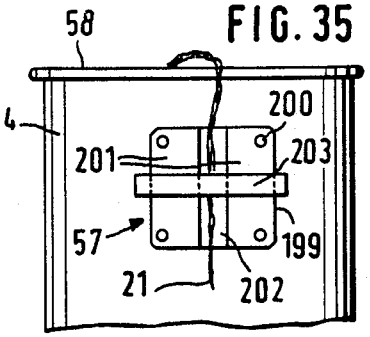

In the embodiment according to FIG. 35, a plate 199 is mounted as a holding device 57 at a distance below the edge 58 and of the can 4 by means of rivets 200 or screws or the like, this plate 199 having a groove-shaped indentation 202 between two elevations 201. The plate 199 consists of a magnetic material. When the end portion 21 of the sliver is fixed, the devices for the gripping and fixing of this end portion 21 apply a sheet metal strip 203 to the plate 199 which magnetically adheres to the plate 199 and which, in the process, secures the end portion 21. The sheet metal strip 203 then, at the second machine 2, during the gripping of the end portion 21 of the deposited sliver, is taken off again and collected and, if necessary, is conveyed back into the range of the first machine 1. In a similar manner, it is contemplated to secure the end portion 21 of the sliver by means of adhesive strips or the like at the exterior wall of the can 4 which then does not require any special development for this purpose. An adhesive strip of this type, instead of which a plate-shaped label may also be used, may also be provided with a coding which supplies information on the contents of the container. The application of adhesive strips or plate-shaped adhesive labels may take place in the manner which is known in the case of labelling machines.

Figure 36:
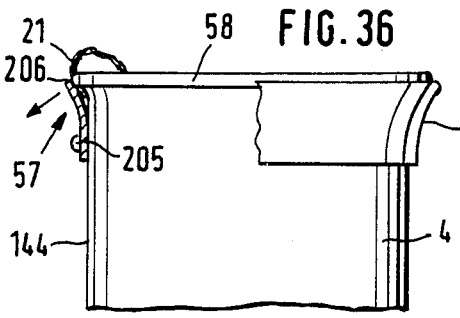

In the embodiment according to FIG. 36, a band 204 consisting of a rubber-elastic material which is placed around the exterior wall of the can 4, is used as the holding device 57, this band 204, at one or several points, being fastened by means of rivets 205 or the like. This rubber band, with its upper edge 206, places itself on the outside against the edge 58 of the can 4. This upper edge 206 can easily be spread away from the edge 58, whereby it becomes possible to insert the end portion 21 of the sliver in this area. After the edge 206 is released, the end portion 21 will be secured between the edge 58 and the band 204. The spreading-away may take place, for example, by means of a suction device or the like.

Figure 37:
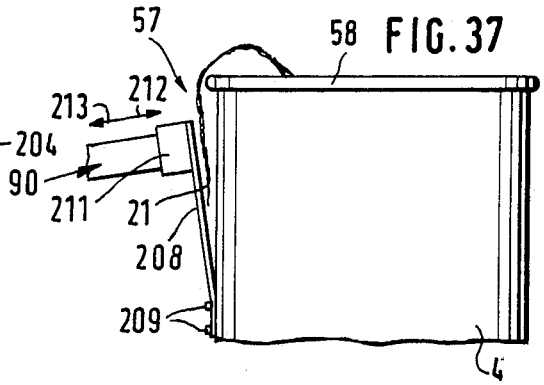

In the embodiment according to FIG. 37, a metallic spring band 208 is fastened on the outside at a can 4 by means of rivets 209. This metallic spring band 208, which extends in vertical direction and is fastened at its lower end at the can 4. By means of an actuating device 90, which can be moved in the direction of the arrows 212, 213, band 208 can be folded away from the exterior wall of the can 4 so that the end portion 21 of a sliver may be placed between the exterior wall of the can 4 and the band 208. The actuating device 90 may also have, for example, a suction gripper 211 or a switchable solenoid by means of which it can grip the spring band 208.

Figure 38:
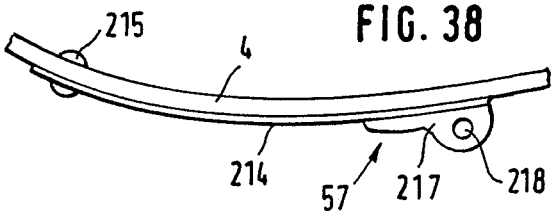

The embodiment according to FIG. 38 corresponds essentially to the embodiment according to FIG. 37; i.e., a metallic spring band 214 is fastened on the outside of the can 4, in which case the fastening takes place at one end by means of rivets 215. In this embodiment, however, the spring band 214 extends in circumferential direction of the can 4. The spring band 214 is provided at its end with a gripping tab 217 having an eye 218. The gripping tab 217 may be gripped by means of tongs or the like or by means of a hook of an actuating device 90. Instead of metallic spring bands 208, 214, spring bands of a suitable plastic material may also be provided.

Figure 39:
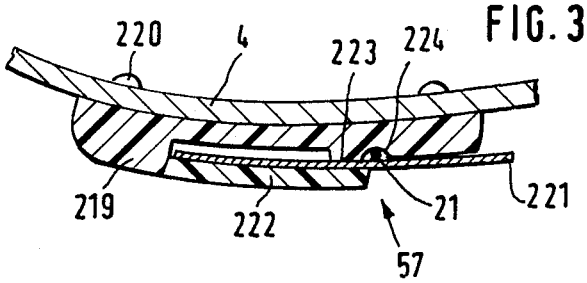

In principle, the embodiment according to FIG. 39 corresponds to the embodiment according to FIG. 37 or 38, in which case, however, the exterior wall of the can 4 is not used as part of the clamping holding device 57. In the embodiment according to FIG. 39, a plastic body 219 is fastened at the exterior wall of the can 4 by means of rivets 220, a spring band 221 being injection-molded into this plastic body 219. The spring band 221 rests on an elevated surface 223 which is provided with a groove 224, into which the end portion 21 of the sliver is placed. On its exterior side, the spring band 221 is at least partially still covered with plastic 222. The opening of the holding device 57 constructed as a clamp takes place by means of an actuating .device 90 which is equipped with a magnet which is applied to the spring band 221. In the same manner, a hook-type gripping element may also be provided which is applied to the end of the spring band 221 projecting over the basic plastic body 219.

Figure 40:
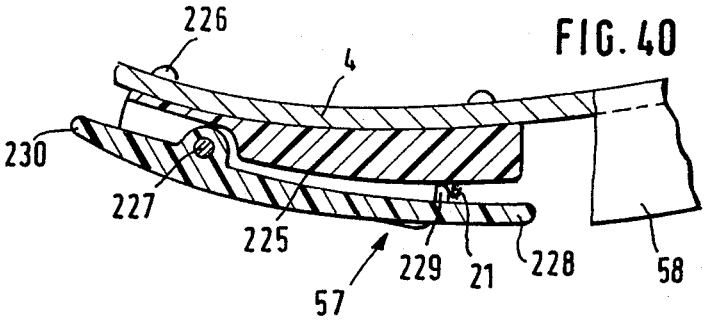

In the embodiment according to FIG. 40, a plastic component is provided as the holding device 57 which has a basic body 225 fastened by means of rivets 226 or the like at the exterior side of a can 4. Inside a groove, which is delimited by two lateral tabs 229, a clamping lever is located which is formed by two arms 228, 230 and which can be swivelled around a shaft 227. The clamping lever 228, 230 is held by means of a spring, which is not shown, in the shown clamping position, in which the end portion 21 of the sliver rests against the front ends of the elevations 229. As shown in FIG. 40, the whole holding device 57 of FIG. 40 is constructed such that it is located below the area which is covered by the flange-type widened edge 58 of the can 4.

Figure 41:
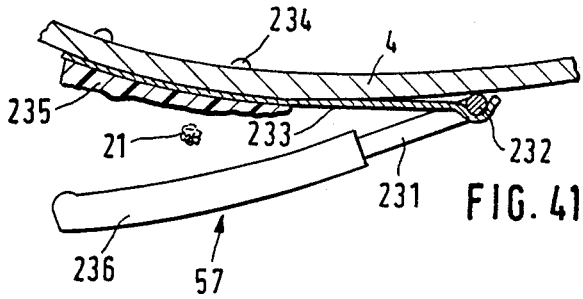

In the embodiment according to FIG. 41, a holder is fastened at the exterior wall of a can 4 by means of rivets 234 or the like, this holder consisting of a plastic support 235 and a spring plate 233. The spring plate 233 has an elbow-shaped area into which a transverse web 232 of a U-shaped or L-shaped bracket 231 is placed which, by means of the spring plate 233, is pressed against the exterior wall of the can 4. The transverse web 232 is used as the pivotal shaft for the bracket 231 which is provided with a plastic jacket 236. The spring plate 233 presses the transverse web 232 against the exterior wall of the can 4 in such a manner that a considerable frictional force exists which impairs a swivelling of the bracket 231; i.e., the bracket 231 remains stationary in any position given to it. If, from the shown opened position, after the inserting of the end portion 21 of a sliver, it is pressed against the plastic body 235, it remains stopped in front of it and there secures the end portion 21 of the sliver.

In the embodiment according to FIG. 42, a base plate 238 is mounted at a distance below the edge 58 at the exterior wall of a can 4, this base plate 238 carrying he actual holding device 57. At the base plate 238, a plastic body 240 is stationarily arranged by means of rivets 239 or the like, a similarly shaped plastic body 242 being located opposite this plastic body 240, the plastic body 242, together with the first plastic body 240, forming a guiding groove which has a funnel-shaped widening 245 and then forms a clamping point 244. The component 242 is held pivotably around a pivot shaft 243 at the plate 238. On the inside, this component 242 is loaded by a spring 247 which supports itself at an interior wall 249 of the body 242 and a stationary stop 248 of the plate 238.

The body 240 is provided with a center hole 241 which is assigned to a positioning device. Into this center hole 241, a take-along element of the positioning device may engage and may then align the holding device 57 precisely in the desired position. The body 242 has a recess 246 into which an element of an actuating device 90 engages which swivels the body 242 for the opening of the clamping holding device 57 around its shaft 243.

Figure 42:
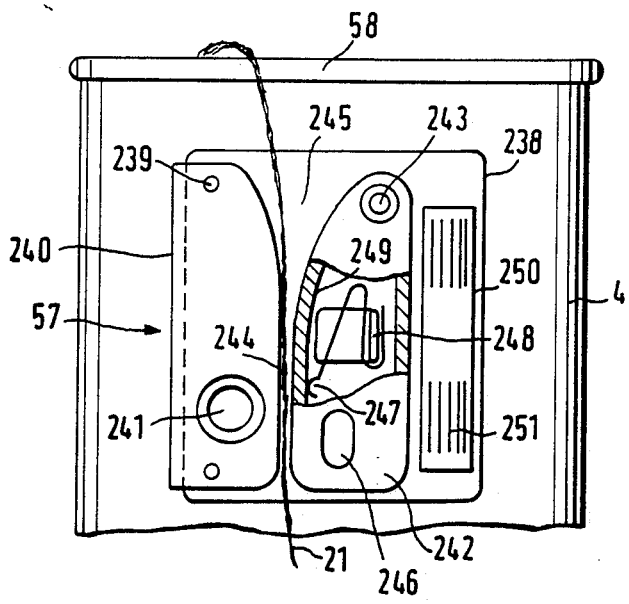

To the plate 238 of the embodiment according to FIG. 42, a coding element 250 is also applied, for example, in the form of an adhesive label, which is provided with recognition markings 251 which can be read optically, electrically or electronically. Instead of an adhesive label 250, it is also contemplated to provide electronically codable elements fixed in the plate 238.

Figure 43:
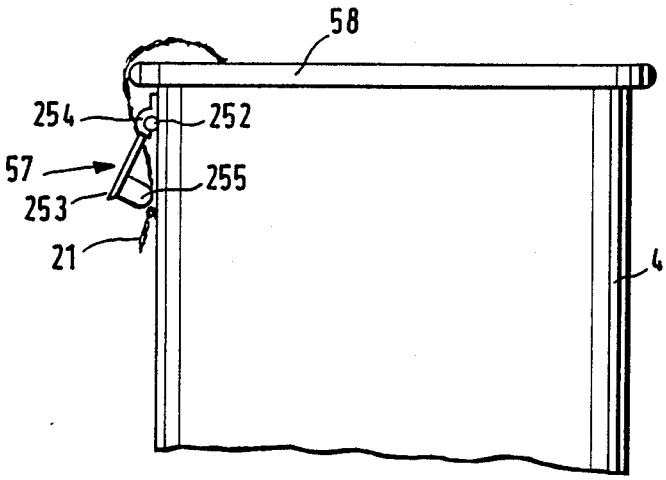

In the embodiment according to FIG. 43, a bearing holder 254 is arranged below the edge 58 of a can 4, a shaft 252 being able to be clipped into this bearing holder 254. The shaft 252 is part of a swing holder 253 which, by means of a pressure element 255, on the outside, comes to rest against the exterior wall of the can 4 as a result of its own weight. The pressure element 255, which extends laterally beyond the holder 253, clamps the end portion 21 of a sliver against the exterior wall of the can 4 as a result of its own weight and possibly with the aid of an additional rotary spring. The holder 253 can very easily be detached from the bearing holder 254 and be reconnected with it.

In the embodiment according to FIG. 44, a molded part 256 is arranged as the holding device below the edge 58 of a can 4 at its exterior wall, this molded part 256 being fastened by means of rivets 257. The molded part 256 has a saucer-type recess 258, into which a roller 262 places itself which is arranged on a holder 259 so that it can be pivoted around a shaft 261, this holder 259, in turn, being pivotable around a horizontal shaft 260. The holder 259 is slightly swivelled away for the inserting of the end portion 21 of a sliver and then released so that the roller 262, as the result of the dead weight of the holder 259 and of the roller 262, places itself clampingly against the end portion 21.

Figure 44:
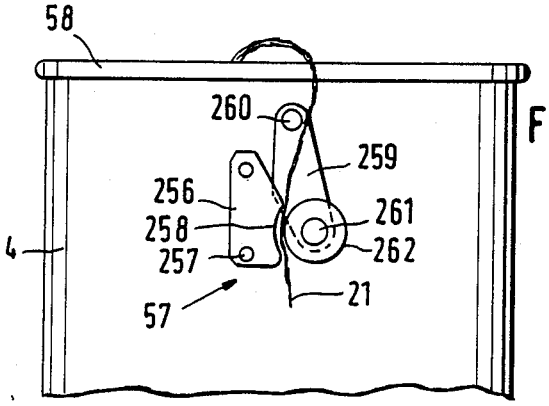

As a modification of the embodiment according to FIG. 44, it is provided that, instead of the molded part 256, a second roller 262 is provided which correspondingly is held by means of a holding arm 259. The sliver is then braced between two such rollers as a result of their own weight plus the own weight of the holding arms 259.

Figure 45:
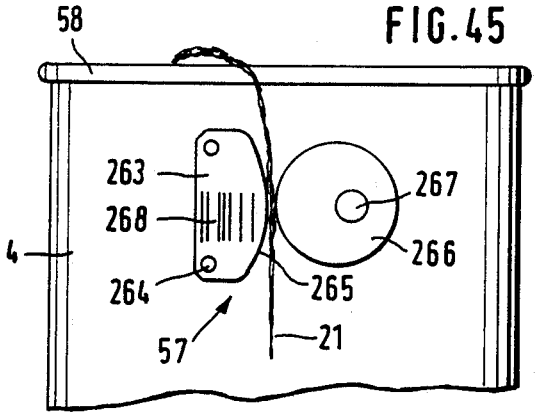

In the embodiment according to FIG. 45, a molded part 263 is fastened by means of rivets 264 at the exterior wall of a can 4 below the edge 58. The molded part 263 has a convexly arched surface 265, a wheel 266 being located opposite it, which can be rotated around an eccentric shaft 267 fixed at the can 4. The wheel 266, together with the molded part 263, forms a guide. By means of the rotation of the wheel 266 around its eccentric shaft 267, the clamping gap can be changed between the molded piece 263 and the wheel 266 so that the end portion 21 of a sliver is clamped in or released. Expediently, it may be provided that the wheel 266 has a high friction with respect to its shaft 267 so that it automatically remains in each adjusted position and can be opened and closed only after overcoming a certain force.

The plastic body 263 is provided with a coding 268 concerning the content of the can. In addition, it is also contemplated to let the plastic body 263 project radially so far from the can wall that it can be utilized as a stop, with which a positioning device cooperates. As a modification of the shown embodiment according to FIG. 45, it is provided that a second wheel cooperates with wheel 266, this second wheel also being disposed eccentrically.

Figure 46:
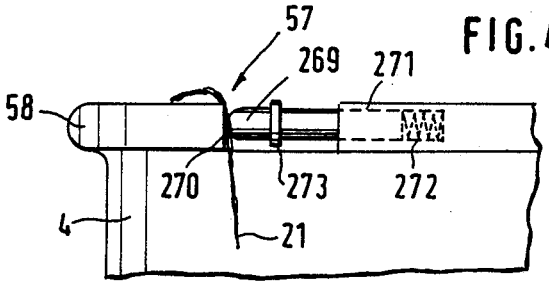

In the embodiment according to FIG. 46, the holding device 57 is worked into the edge 58 of a can 4. The edge 58 is provided with a cutout 270. A pressure spring 272 is also worked into the edge 58, this pressure spring 272 cooperating with a tappet 269 arranged in a guide 271, this tappet 269, by means of the pressure spring 272, being pressed in the direction of the opposite wall of the cutout 270. The tappet 269 is provided with a collar 273 so that it can be gripped for the opening by means of a tool of an actuating device. The tappet 269 therefore clamps the end 21 of the sliver with a limiting wall of the recess 270 of the edge 58 of the can 4.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A process for processing textile fibers, comprising:

producing sliver in a first machine and depositing said sliver in containers, and conveying said containers with sliver to a second machine for further processing of the slivers, wherein said depositing of said sliver in respective containers at said first machine includes automatically gripping an end portion of said sliver with gripping means and fixing said end portion to a specified position at the respective containers by sliver end fixing means, wherein said end portion is severed from the supply of sliver from the first machine by severing means and already fixed at a specified position of the respective containers before the containers are conveyed to the second machine, thereby assuring proper orientation of the end portions at the containers during the subsequent conveying and processing at the second machine, and wherein the sliver end fixing means include gripping means for gripping respective end portions of the sliver, said gripping means including at least one arm provided with a receiving device for the sliver, this arm being applicable to the sliver and to the pertaining container.

2. A process according to claim 1, wherein said sliver end fixing means includes sliver end detaching means for detaching respective end portions of the sliver filled into a container from the sliver running out of the first machine.

3. A processing according to claim 1, wherein each container is equipped with securing means for securing end portions of the sliver filled into the respective container, said securing means comprising at least a portion of the sliver end fixing means.

4. A process according to claim 2, wherein the securing means contain non-clamping receiving elements.

5. A process according to claim 1, wherein said first machine is a sliver drafting machine and said second machine is an open end spinning machine.

6. A machine system for processing textile fibers, comprising:

a first machine for producing sliver and depositing said sliver in respective sliver containers, a second machine for further processing the sliver deposited in the sliver containers at the first machine, conveying means for conveying the sliver containers from the first machine to the second machine, and sliver end fixing means at the first machine for automatically fixing sliver ends to specified positions on the respective sliver containers with severing of the sliver ends from the supply of sliver from the first machine by way of severing means, thereby assuring proper orientation of the end positions at the containers during the subsequent conveying and processing at the second machine, wherein the sliver end fixing means include gripping means for gripping respective end portions of the sliver, said gripping means including at least one arm provided with a receiving device for the sliver, this arm being applicable to the sliver and to the pertaining container.

7. A machine system according to claim 6, wherein said sliver end fixing means includes sliver end detaching means for detaching respective end portions of the sliver filled into a container from the sliver running out of the first machine.

8. A machine system according to claim 6, wherein each container is equipped with securing means for securing end portions of the sliver filled into the respective container, said securing means comprising at least a portion of the sliver end fixing means.

9. A machine system according to claim 8, wherein the securing means contain non-clamping receiving elements.

10. A machine system according to claim 6, wherein said first machine is a sliver drafting machine and said second machine is an open end spinning machine.

* * * * *